United States Patent [19]

Tsuchida et al.

[11] Patent Number: 4,537,240

[45] Date of Patent: Aug. 27, 1985

[54] APPARATUS FOR CONTINUOUS CASTING

[75] Inventors: Yutaka Tsuchida, Yokosuka; Toshiyuki Fukai, Yokohama, both of Japan

[73] Assignee: Ishikawajima-Harima Jukogyo Kabushiki Kaisha, Tokyo, Japan

[21] Appl. No.: 502,722

[22] Filed: Jun. 9, 1983

[30] Foreign Application Priority Data

Jun. 23, 1982 [JP] Japan ..... 57-107837

[51] Int. Cl.[3] ..... B22D 11/06

[52] U.S. Cl. ..... 164/430; 164/479

[58] Field of Search ..... 164/479, 427, 430, 342

[56] References Cited

U.S. PATENT DOCUMENTS 1,863,371 6/1932 Greene ..... 164/430
2,058,762 10/1936 Bible ..... 164/342
3,538,978 11/1970 Boehm ..... 164/479
4,399,859 8/1983 Marcil ..... 164/342
4,425,958 1/1984 Luthy et al. ..... 164/137 X

FOREIGN PATENT DOCUMENTS 89828 8/1976 Japan .

*Primary Examiner*—Nicholas P. Godici
*Assistant Examiner*—J. Reed Batten, Jr.

[57] ABSTRACT

Moving molds are disposed in one array around the periphery of a casting wheel. A series of consecutive moving molds are closed during a predetermined angle range of the periphery of the casting wheel to define a continuous mold cavity between the closed moving molds and the casting wheel. A molten metal is poured into the thus defined continuous molding cavity at an upstream end thereof and is solidified while the casting wheel is rotated in unison with the moving molds. Then, moving molds are opened just before they arrive a cast outlet, and the cast is taken out.

5 Claims, 10 Drawing Figures

APPARATUS FOR CONTINUOUS CASTING

BACKGROUND OF THE INVENTION

The present invention relates to a process and apparatus capable of continuous casting at high speeds with a high degree of efficiency.

The present demand is to cast thin slabs at high speeds with a high degree of efficiency for facilitation of a rolling process. To this end, there has been proposed and demonstrated a rotary type continuous casting process in which a rotary casting wheel is combined with a belt.

In FIGS. 1(*a*) and 1(*b*) is shown one example of the prior art rotary type continuous casting processes. A rotatable casting wheel 1 has the outer peripheral surface formed with an annular groove 1*a* as best shown in FIG. 1(*b*). A soft-steel endless belt 2 is partially wrapped around the casting wheel 1 and is pressed against the outer periphery of the casting wheel 1 by means of a plurality of belt guides 3, whereby a casting mold 4 is defined by the groove 1*a* of the casting wheel 1 and the belt 2. The belt guides 3 have the double function of pressing the belt 2 against the casting wheel 1 and cooling the belt 2. The endless belt 2 is rotated by a suitable prime mover in the direction opposite to the direction of rotation of the casting wheel 1.

The casting wheel 1 is rotated in the direction indicated by the arrow D1 while the endless belt 2 is driven in the direction indicated by the arrow D2 at a velocity equal to the peripheral velocity of the casting wheel 1. A tundish 5 into which is poured molten metal 6 is disposed immediately above the position at which the molding space 4 is initially defined by the casting wheel 1 and the belt 2. The molten metal 6 is poured into the molding space 4 and the poured molten metal 6 moves in unison with the casting wheel 1 and the belt 2 in the molding space 4 defined therebetween. (The position at which the molding space 4 is defined remains unchanged, but the molding space 4 moves in unison with the molding wheel 1 and the belt 2.) While the molten metal 6 moves, it is cooled. That is, the outer skin is solidified so that a continuous slab 7 is formed and is transported toward the position at which the molding space 4 is terminated. The slab 7 is then withdrawn from the molding space 4 or the annular groove 1*a* of the casting wheel 1 by means of pinch rollers 8. In order to facilitate the separation of the slab 7 from the annular groove 1*a* of the casting wheel 1, the opposing side walls of the groove 1*a* are tapered so that the groove 1*a* is trapezoidal in cross section as best shown in FIG. 1(*b*). In order to force the separation of the slab 7 from the groove 1*a*, a knife 9 is disposed of the outlet of the slab 7 from the casting wheel 1. A cutting device 10 is provided to shear the slab 7.

With the process of the type described, molten metal can be cast at high speeds with a high degree of efficiency. But such process has the following problems:

(1) The endless belt 2 is externally cooled. Since the belt 2 directly contacts the molten metal 6, the cooling-and-heating cycle of the belt is very fast so that the belt 2 is deformed very rapidly; that is, the belt is elongated and shrinked. Furthermore, due to the deformations of the belt 2, there tends to exist a space between the casting wheel 1 and the belt 2 so that the molten metal 6 leaks through this space. The counter-measure for preventing such leakage presents serious problems. As a result, there has long been a demand for materials which can improve the endless belt 2, but at present only the soft steel is the most suitable material for the endless belt 2.

(2) In the case of casting a wide slab by the process described above, the endless belt 2 is subjected to greater deformations. Thus, it becomes very difficult to design and construct a suitable endless belt 2.

(3) As described above, in order to facilitate the separation of the slab 7 from the groove 1*a*, the side walls of the groove 1*a* are tapered. As a result, when the slab 7 is pulled out of the groove 1*a*, the side walls of the groove 1*a* are rigorously rubbed by the slab 7 and consequently severely abraded and worn. Thus, in order to remedy the deformed and worn side walls of the groove 1*a*, a considerably large amount of materials must be removed and consequently the use of the casting wheel 1 is limited. As a result, the cost is increased.

(4) Since the side walls of the groove 1*a* are tapered, the cast slab 7 becomes trapezoidal in cross section; the trapezoidal slab 7 is nonuniformly cooled and solidified so that cracks are propagated and consequently the poor product results and breakouts occur very frequently. Moreover, the step for remedying the trapezoidal slab 7 into a slab rectangular in cross section is needed. As a result, the installation cost is increased uneconomically.

(5) In order to force the separation of the slab 7 from the groove 1*a*, the knife 9 is provided adjacent to the discharge end of the slab 7. It is very difficult, however, to dispose the knife having sufficiently high mechanical strength in a limited space adjacent the discharge end. In addition, the construction adjacent to the discharge end becomes very complex. As a result, in the case of a breakout, it takes a long time to remedy it.

The prior art continuous casting process and machine which uses the endless belt 2 as described above have the above-described inherent problems.

The present invention was made to overcome the above and other problems encountered in the conventional continuous casting processes and machines and has for its object to provide a novel continuous casting process and apparatus which substantially overcome the above described problems.

According to the present invention, the continuous casting can be carried out without the use of an endless belt. A plurality of movable molds which can be opened and closed are disposed in an array around the outer periphery of a rotary casting wheel and when a predetermined number of consecutive moving molds are closed, a continuous mold cavity is defined along part of the outer periphery of the casting wheel. While the casting wheel is rotated, a predetermined number of moving molds are closed during a predetermined angular range while the remaining moving molds are opened during the remaining angular range. A molten metal is poured in the thus defined continuous mold cavity and at least the skin of the body of molten metal poured into the continuous mold cavity is solidified while the moving molds revolve in unison with the casting wheel, whereby a continuous slab is cast and removed at the position where the closed moving mold is opened. The above-described step is cycled continuously, whereby a continuous slab is produced.

The above and other objects, effects and features of the present invention will become more apparent from the following description of preferred embodiments thereof taken in conjunction with the accompanying drawings.

BRIEF DESCRIPTION OF THE DRAWINGS

FIG. 1(*b*) is a sectional view, on enlarged scale, taken along the line Ib—Ib of FIG. 1(*a*);

FIG. 5(*b*) is a sectional view taken along the line Vb—Vb of FIG. 5(*a*);

The same reference numerals are used to designate similar parts throughout the figures.

DESCRIPTION OF THE PREFERRED EMBODIMENTS

Figure 2:
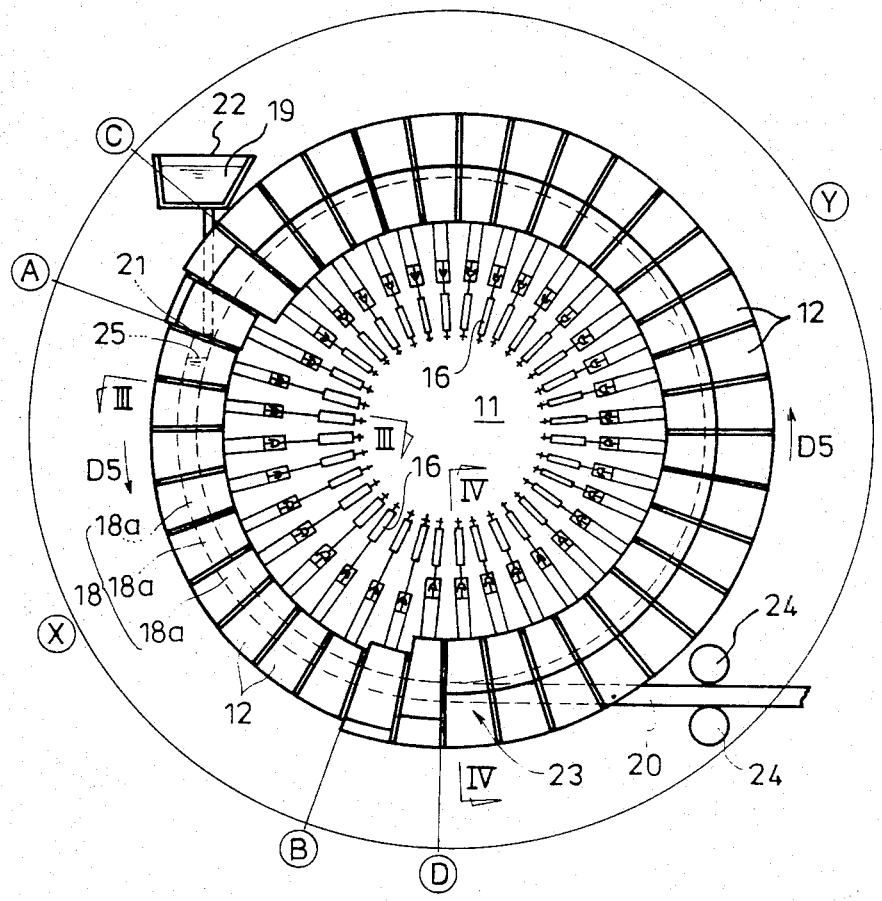
FIG. 2 is a side view of a first embodiment of a rotary type continuous casting machine in accordance with the present invention.
Figure 3:
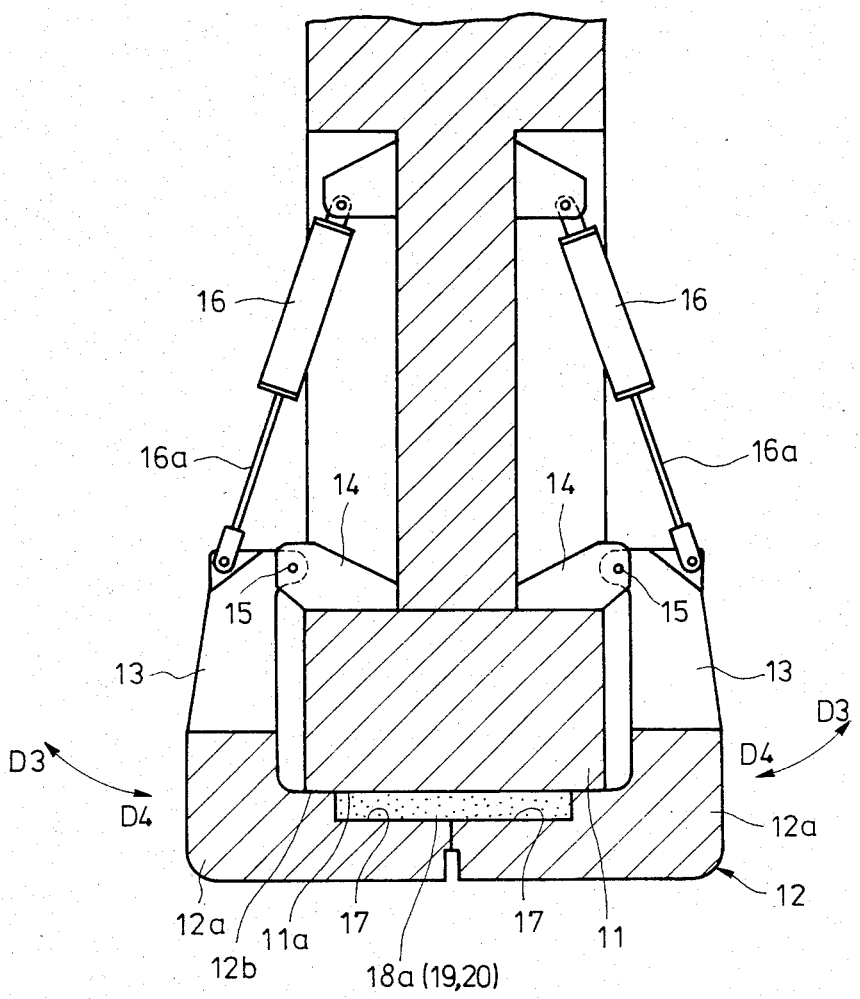
FIG. 3 is a sectional view, on enlarged scale, taken along the line III—III of FIG. 2.
Figure 4:
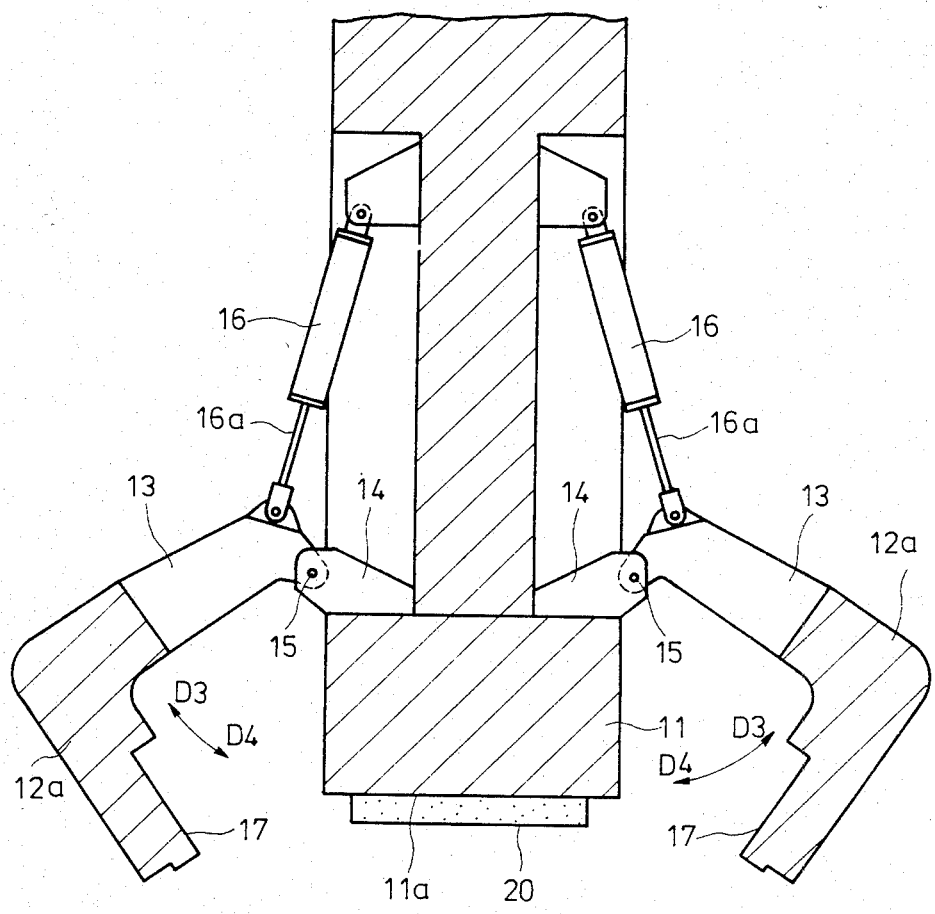
FIG. 4 is a sectional view, on enlarged scale, taken along the line IV—IV of FIG. 2.

In FIGS. 2, 3 and 4 is shown a first embodiment of a continuous casting machine in accordance with the present invention. A casting wheel 11 which is rotatable about a horizontal axis has a plurality of moving molds 12 disposed along the outer periphery and equiangularly spaced apart from each other by a relatively small distance or clearance.

As best shown in FIGS. 3 and 4, each moving mold 12 comprises two symmetrical halves 12*a* which are adapted to move toward or away from each other in a plane prependicular to the axis of rotation of the casting wheel 11. Each mold half 12*a* is L-shaped in cross section and its upper end is formed integral with the lower end of an arm 13. The arm 13 is pivoted at its upper end with a pivot pin 15 to a bracket 14 which in turn is securely attached to the side wall of the casting wheel 11. A power cylinder 16 is pivoted at its base to a bracket which in turn is securely fixed to the side wall of the casting wheel 11 while the leading end of its piston rod 16*a* is pivoted to the upper end of the arm 13. Therefore, as the piston rod 16*a* of the power cylinder 16 is retracted, the mold half 12*a* is caused to move in the direction indicated by the arrow D3 but when the piston rod 16*a* is extended, the mold half 12*a* is moved in the direction indicated by the arrow D4. Thus both the mold halves 12*a* are adapted to open the outer periphery of the casting wheel 11 as shown in FIG. 4 or to close or surround the outer periphery of the casting wheel 11 as shown in FIG. 3.

As best shown in FIG. 4, the mold halves 12*a* have stepped portions 17 at the inner wall surface in opposed relationship with the outer peripheral surface 11*a* of the casting ring 11. These stepped portions 17 are symmetrical about the parting line of the mold halves 12*a* as best shown in FIG. 3. Therefore when the mold halves 12*a* are moved toward each other in the directions indicated by the arrow D4 so as to mate each other with the inner wall surface 12*b* of the mold halves 12*a* pressed against the outer peripheral surface 11*a* of the casting ring 11, a space 18*a* rectangular in cross section is defined as best shown in FIG. 3. Molten metal 19 or solidified slab 20 fills the thus defined space 18*a*. When the piston rods 16*a* of the power cylinders 16 are retracted, the mold halves 12*a* are moved away from each other and the solidified slab 20 is exposed as best shown in FIG. 4.

A plurality of moving molds 12 each with the above-described construction are arranged along the peripheral surface 11*a* of the casting wheel 11 and a series of moving molds 12 are closed, the spaces 18*a* each defined by each moving mold 12 become continuous; that is, a continuous molding space 18 (See FIG. 2) is defined along a part of the periphery of the casting wheel 11.

The casting wheel 11 and the moving molds 12 may be provided with water jackets so as to cool them. Alternatively, the cooling water may be sprayed from the exterior to cool them. As a result, the molen metal 19 filled in the continuous molding space 18 may be cooled and solidified.

The casting wheel 11 with a plurality of moving molds 12 is rotated in the direction indicated by the arrow D5 (See FIG. 2) by means of a suitable prime move (not shown). When the moving mold 12 has passed past the top of the casting wheel 11 and revolves through a predetermined angle in the counter-clockwise direction to a position Ⓐ, it is closed and is kept closed until it further revolves through a predetermined angle to a position Ⓑ. That is, each moving mold 12 is closed through an angle Ⓧ so that the continuous molding space 18 is defined through the same angle Ⓧ. A nozzle 21 extending from a tundish 22 is opened immediately above the position Ⓐ where the moving mold 12 is closed and the molten metal 19 is poured into the continuous molding space 18 through the nozzle 21.

The moving molds 12 are kept opened through an angle Ⓨ and a slab outlet 23 is located immediately below the bottom of the casting wheel 11. The slab 20 is extracted horizontally from the outlet 23 by pinch rollers 24.

Next the mode of operation of the first embodiment will be described in detail.

When the casting wheel 11 is rotating in the direction indicated by the arrow D5, the moving molds 12 are opened and closed in the manner to be described below. When one moving mold 12 revolves to the position Ⓒ, the power cylinders 16 are actuated so that its piston rods 16*a* are extended and consequently the arms 13 and hence the mold halves 12*a* begin to swing about the pivot pins 15. When the moving mold 12 reaches the position Ⓐ, it is completely closed; that is, the mold halves 12*a* mate together to define the molding space 18*a* as best shown in FIG. 3. While the moving mold 12 revolves through the angle Ⓧ, it is kept closed. As a result, as described before, a plurality of moving molds 12 within the angle Ⓧ form a continuous molding space 18. The molten metal 19 is poured through the nozzle 21 from the tundish 22 into the continuous molding space 18 and is cooled through the surrounding moving mold 12 and the casting wheel 11 and begins to solidify from a meniscus portion 25.

As the molten metal 19 moves in unison with the moving molds 12, it solidifies from its skin and becomes slab 20. At the position Ⓑ, the power cylinders 16 are so actuated that their piston rods 16*a* are extracted and consequently the mold havles 12*a* are moved away from each other; that is, the moving mold 12 is opened as best shown in FIG. 4, whereby the molding space 18*a* and hence the slab 20 are opened.

Thereafter the slab 20 is extracted by the pinch rollers 24. The peripheral velocity of the casting wheel 11 is so controlled as to be equal to the moving velocity of the slab 20. The moving mold 12 is kept opened from the position Ⓑ to the position Ⓒ where the closing operation is started again.

The above-described operation is cycled so that the slab 20 can be continuously cast.

According to the first embodiment of the present invention, therefore, the endless belt 2 may be eliminated and the continuous casting can be carried on at high speeds with a higher degree of efficiency.

Figure 5A:
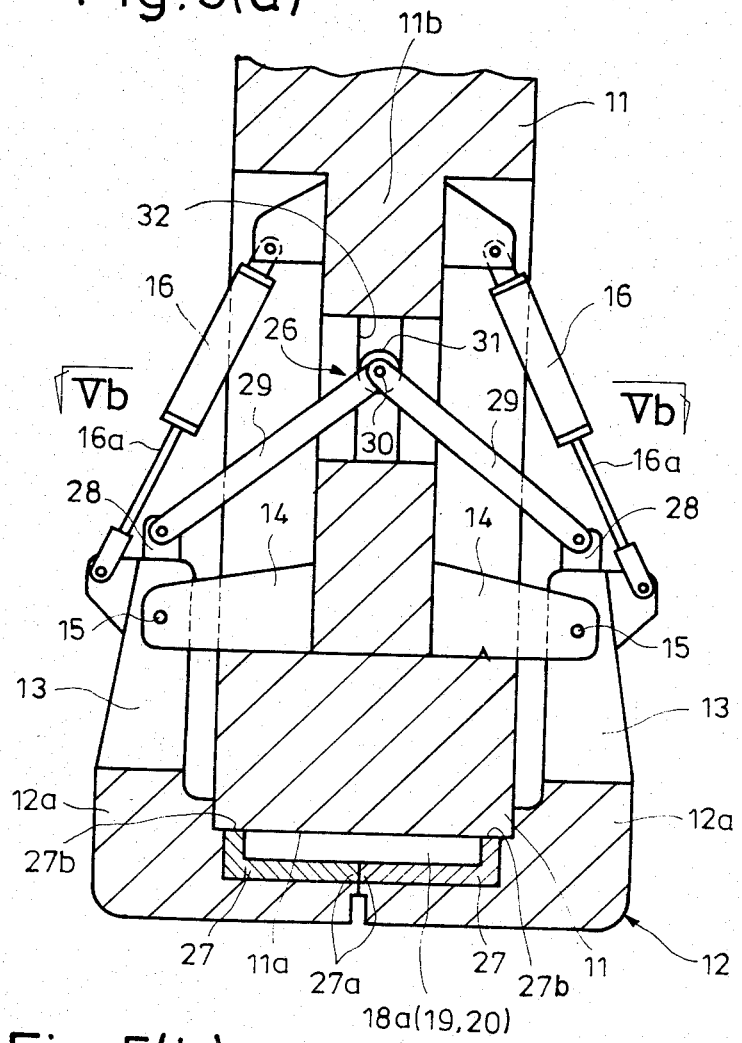
FIG. 5(*a*) shows a second embodiment of the present invention.
Figure 5B:
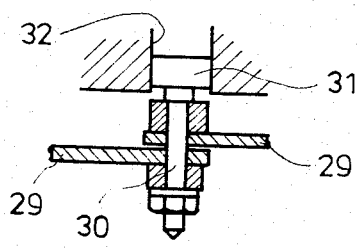

A second embodiment of the present invention is shown in FIGS. 5(*a*) and 5(*b*). The second embodiment is substantially similar in construction to the first embodiment described with reference to FIGS. 3, and 4 except that an equalizing linkage 26 is added and that an L-shaped copper block 27 is fitted into the stepped portion 17. The equalizing linkage 26 is provided in order to synchronize the movement of the mold halves 12*a*. The lower ends of links 29 of the equalizing linkage 26 are pivoted to brackets 28 which in turn are securely fixed to the upper end of the arms 13 while the other ends of the links 29 are pivoted with a common pivot pin 30 to a guide roller 31 which in turn is rotatably carried by the common pivot pin 30. The guide roller 31 is rotatably fitted into a guide groove 32 which is extended radially in an arm or spoke 11*b* of the casting wheel 11 as best shown in FIG. 5(*b*).

Because of the provision of the equalizing linkage 29, the mold halves 12*a* are well balanced with respect to each other and are exactly synchronized in movement. In addition, one of the two power cylinders 16 may be eliminated. That is, the mold halves 12*a* can be moved toward or away from each other in a manner substantially similar to that described above by one power cylinder 16 through the equalizing linkage 26.

Another feature of the second embodiment is that the copper blocks 27 are fitted into the stepped portions 17. To put it another way, the stepped portions 17 are lined with the copper blocks 27. To this end, the stepped portions of the second embodiment are larger in size than those of the first embodiment. When the mold halves 12*a* are mated together, a molding space 18*a* rectangular in cross section may be defined as in the case of the first embodiment.

The mating surfaces 27*a* of the copper block 27 are made into intimate contact with each other and the upper ends 27*b* of the L-shaped copper blocks 27 are made into the intimate contact with the peripheral surface 11*a* of the casting wheel 11 when the molding halves 12*a* are closed. In order that no molten metal may leak through the interface between the L-shaped copper blocks 27 and the interfaces between the L-shaped copper block 27 and the outer peripheral surface 11*a* of the casting wheel 11, the mating surfaces 27*a*, the upper end surfaces 27*b* and the peripheral surface 11*a* of the casting wheel 11 must be finished with a higher degree of surface smoothness.

Figure 6:
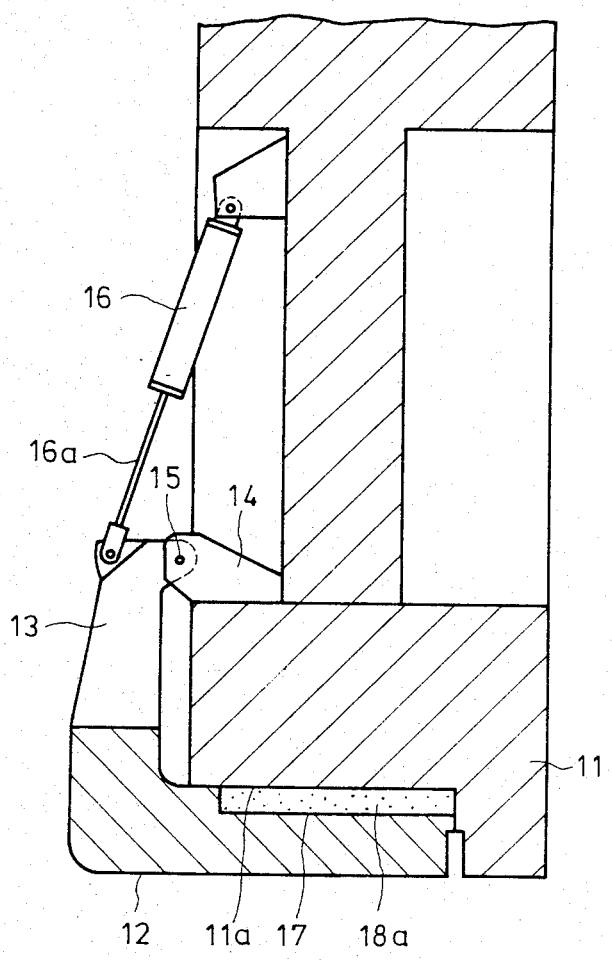
FIG. 6 shows a third embodiment of the present invention.

In FIG. 6 is shown a third embodiment of the present invention in which only one power cylinder 16 is used to open and close a moving mold 12. The outer periphery of the casting wheel 11 is stepped. While the first and second embodiments have two mold halves 12*a*, the third embodiment has only one moving mold 12 with a stepped portion 17 formed in opposed relationship with the stepped portion 11*a* of the casting wheel 11. Therefore when the moving mold 12 is closed, the stepped portion 17 of the moving mold 12 and the stepped portion 11*a* of the casting wheel 11 define a rectangular space 18*a* which is filled with the molten metal 19.

Only one power cylinder 16 is disposed at one side of the casting wheel 11 so as to open and close the moving mold 12 in a manner substantially similar to that described above with reference to FIGS. 3 and 4.

Figure 7:
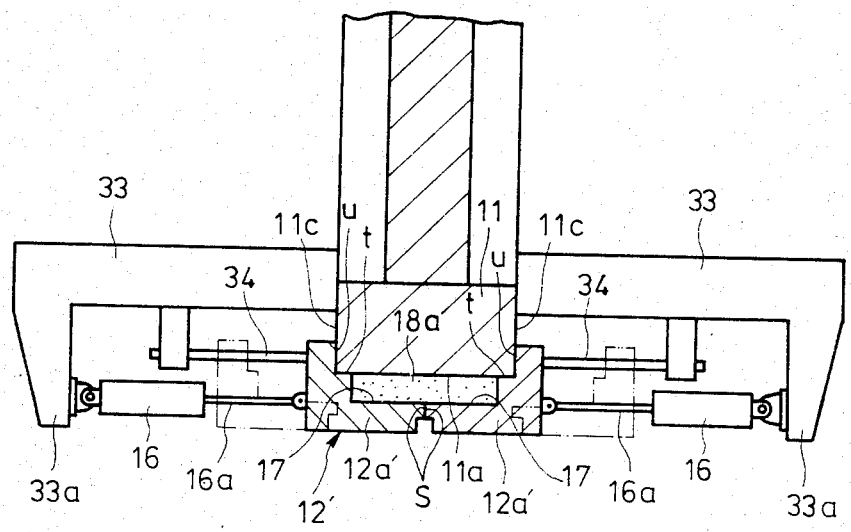
FIG. 7 shows a fourth embodiment of the present invention.

In the first, second or third embodiment, the moving mold halves 12*a*, or the single moving mold 12 has been described as being caused to swing about the pivot pins or pin 15 so as to define a molding cavity, but according to a fourth embodiment shown in FIG. 7, a pair of moving molds 12*a'* are caused to move toward or away from each other straightly in parallel with the axis of rotation of the casting wheel 11.

Referring to FIG. 7, the casting wheel 11 has two L-shaped brackets 33 extended from both sides of the casting wheel 11 in parallel with the axis of rotation thereof. The base of the power cylinder 16 is pivoted to the short arm or depending portion 33*a* of the L-shaped bracket 33 and the free end of the piston rod 16*a* thereof is pivoted to the mold half 12*a'* and is extended in parallel with the axis of rotation of the casting wheel 11. Therefore when the power cylinders are actuated so that their piston rods 16*a* are extended, the mold halves 12*a'* are moved towards each other, but when the piston rods 16*a* are retracted, the mold halves 12*a'* are moved away from each other. As is the case of the first embodiment, the mold halves 12*a'* are provided with stepped portions 17 so that when they mate each other, a molding cavity or rectangular space 18*a* which is filled with molten metal is defined. In this case, mating surfaces s of the mold halves 12*a'* are made into very close contact with each other. Vertical side wall surfaces u of the stepped portions 17 of the mold halves 12*a'* are also made into intimate contact with side surfaces 11*c* of the casting wheel 11. In like manner, horizontal side wall surfaces t of the stepped portions 17 of the mold halves 12*a'* are made into very intimate contact with the peripheral surface 11*a* of the casting wheel 11. Thus a completely liquid-tight molding space or cavity 18*a* can be defined.

One end of a guide bar or rod 34 is securely fixed to a bracket depending from the L-shaped bracket 33 while the other end is securely fixed to the side surface 11*c* of the casting wheel 11 and the mold half 12*a'* is guided by this guide rod 34. Therefore the smooth and stable movement of the mold halves 12*a'* may be ensured.

So far the fourth embodiment has been described as having a pair of mating mold halves 12*a'*, but it is to be understood that only one mold may be used as in the case of the third embodiment described with reference to FIG. 6.

It is to be further understood that various modifications of the mechanism for opening and closing the moving mold may be effected without departing the true spirit of the present invention.

Figure 8:
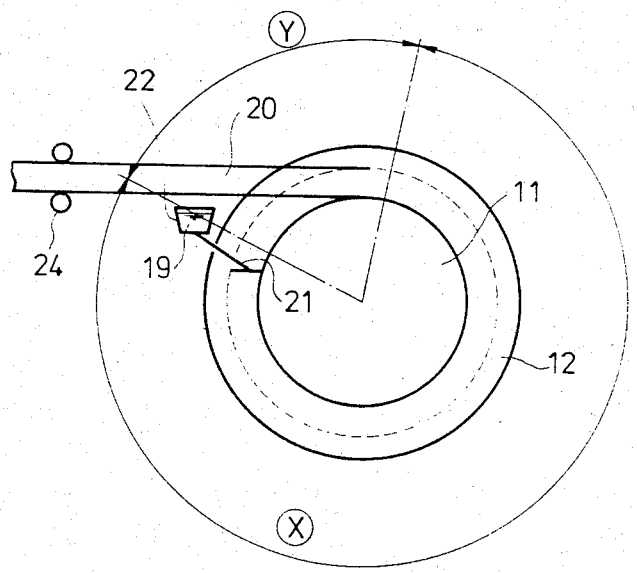
FIG. 8 shows a fifth embodiment of the present invention.

So far the molten metal pouring position where the molten metal 19 is poured through the nozzle 21 and the slab discharging pisition where the slab 20 is separated from the casting wheel 11 have been described as being angularly spaced apart by about 90° (See FIG. 2). To put it another way, the arcuate continuous molding cavity 18 subtends an angle of about 90°. However, it is possible in accordance with the present invention that an arcuate continuous casting section Ⓧ may subtend an angle of 270° as shown in FIG. 8. In this case, during the arcuate section Ⓨ, the moving molds 12 are kept opened. Therefore the continuous casting section can be increased in length and consequently the cooling time can be increased. Thus according to the present invention, the section in which the moving molds 12 are closed and the section in which the moving molds 12 are opened can be suitably selected and consequently the cooling time can be suitably selected.

Figure 1:
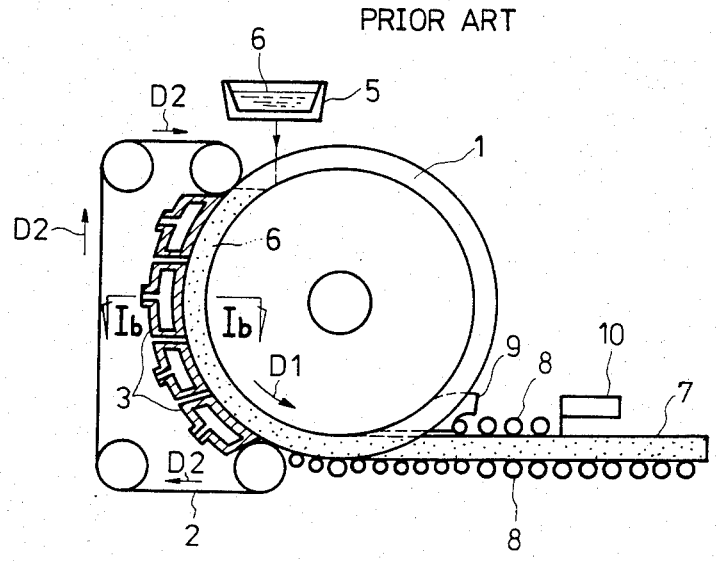
Fig. 1 (a) PRIOR ART
FIG. 1(*a*) is a side view of a prior art rotary type continuous casting machine.
Figure 1:
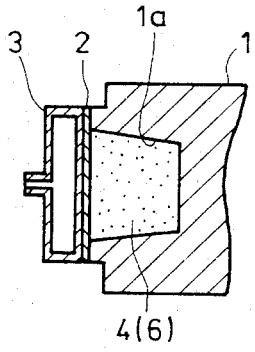
Fig. 1 (b) PRIOR ART

As described above, according to the present invention, the continuous casting operation can be carried out at high speeds and a high degree of efficiency without the use of an endless belt of the type described with reference to FIG. 1. As a result, the problems resulted from the use of an endless belt can be substantially eliminated. More particularly, according to the present invention, instead of a thin and soft belt, the moving molds are in the form of a rigid body having a high mechanical strength. As a consequence, the moving molds are prevented from being thermally deformed and may have a long service life. In addition, leakage of molten metal can be avoided so that the safe continuous casting operation can be ensured. Since the moving molds in accordance with the present invention have a high degree of strength and are free from thermal deformations, not only billets and blooms but also thin slabs with a larger width may be produced. The moving molds 12 may be provided with water jackets so as to cool them. As a result, the cooling efficiency can be remarkably improved. In addition, the copper blocks which have a high thermal conductivity can be used to make direct contact with molten metal. These copper blocks are reinforced by the steel blocks. Therefore the cooling efficiency can be further improved and the lifetime can be further increased.

The arcuate section in which the moving molds are kept closed can be suitably selected. If this section is increased in length, the molding cavity can be also increased in length and the cooling time can be increased accordingly, whereby the continuous casting can be carried out at higher speeds.

While the conventional rotary type continuous casting machines define the molding cavity by an annular groove formed in the outer periphery of the casting ring, according to the present invention the moving molds can define a continuous molding cavity and when the moving molds are opened, the molding cavity is exposed so that the slab or the like can be easily separated from the casting wheel. As a result, the knife (See FIG. 1) can be eliminated which is used in the conventional continuous casting machine for separating the slab from the casting wheel. Thus the present invention can substantially overcome the problems encountered in the conventional rotary type continuous casting machines in which a molding cavity is defined by an endless belt and an annular groove formed in the outer periphery of a casting wheel. As a result, the present invention can produce high-quality slabs or the like.

What is claimed is:

1. A machine for continuously casting at high speed a thin strip of metal from a molten metal bath comprising:

(a) a rotary casting wheel provided with a casting ring on the outer periphery thereof;

(b) a plurality of contiguous molds pivotally carried by said casting wheel, each of said molds being moveable between open and closed positions and cooperating with said casting ring to define, upon closing, a continuous cavity along part of the outer periphery of said wheel to form said cast metal strip, each said mold being L-shaped in cross section at the point of contact with said casting ring;

(c) means for pivoting said molds to open and close said molds in sequence during rotation of said wheel, thereby permitting molten metal to be poured into closed molds, to solidify in said closed molds, and to be removed from open molds in the form of a casting, said means for pivoting said molds including a power cylinder pivotally affixed to said wheel and an arm connected to each said mold;

(d) means for pouring molten metal into said closed molds; and (e) means for removing the resulting casting from said open molds in the form of a continuous thin strip of metal.

2. A machine according to claim 1, wherein said molds each comprise two L-shaped, pivotally supported half mold segments, the innermost portions of which abut one another in the closed positon and define, together with the outer periphery of said casting ring, the continuous cavity for forming said casting.

3. A machine according to claim 2, wherein each said mold segment is provided with a copper lining on the inside thereof facing said casting ring and defining said cavity.

4. A machine according to claim 2, wherein said arms on each said mold are provided with equalizing linkage means pivotally connected thereto and to said wheel to synchronize movement of said half mold segments.

5. A machine according to claim 2, wherein guide rods are axially disposed on said casting wheel and extending through said half mold segments to support and guide said segments as they are opened and closed.

* * * * *